US006857375B2

(12) United States Patent
Milligan et al.

(10) Patent No.: US 6,857,375 B2
(45) Date of Patent: Feb. 22, 2005

(54) TRACTION PINS FOR RAILWAY CARS

(75) Inventors: Bruce A. Milligan, Pataskala, OH (US); Patrick M. Murphy, Canal Winchester, OH (US); Steven R. Pinkstock, Amanda, OH (US)

(73) Assignee: Columbus Steel Castings Co., Columbus, OH (US)

( * ) Notice: Subject to any disclaimer, the term of this patent is extended or adjusted under 35 U.S.C. 154(b) by 0 days.

(21) Appl. No.: 09/864,787

(22) Filed: May 24, 2001

(65) Prior Publication Data

US 2002/0011174 A1 Jan. 31, 2002

Related U.S. Application Data

(60) Provisional application No. 60/207,080, filed on May 25, 2000.

(51) Int. Cl.[7] ..... B61F 5/00
(52) U.S. Cl. ..... 105/199.4
(58) Field of Search ..... 105/34.1, 157.1, 105/165, 167, 182.1, 199.1, 199.4, 189

(56) References Cited

U.S. PATENT DOCUMENTS 1,653,564 A * 12/1927 Hawley ..... 105/199.4
1,806,075 A * 5/1931 Martin ..... 105/189
1,900,682 A * 3/1933 Alcott ..... 105/199.4
2,987,851 A 6/1961 Bonanno
4,242,021 A * 12/1980 Sloane ..... 410/96
4,442,709 A 4/1984 Waters
4,638,742 A * 1/1987 Potel et al. ..... 105/199.3
4,819,566 A * 4/1989 Smith et al. ..... 105/168
4,861,969 A 8/1989 Kicherer et al.
4,867,071 A 9/1989 Weber
4,942,824 A * 7/1990 Cros ..... 105/199.4
5,809,898 A 9/1998 Kaufhold et al.
5,809,899 A * 9/1998 Kaufhold et al. ..... 105/199.4
6,267,062 B1 7/2001 Hamilton, Jr.
6,360,671 B1 * 3/2002 Nakagami ..... 104/168

OTHER PUBLICATIONS

International Search Report from International Patent Application PCT/US01/17154, Aug. 2001.

* cited by examiner

*Primary Examiner*—Mark T. Le
(74) *Attorney, Agent, or Firm*—Banner & Witcoff, Ltd.

(57) ABSTRACT

A one-piece, cast traction pin for use with railway cars. The traction pin is used to connect the railcar cab with the railcar truck assembly. The traction pin includes a mounting plate cast integral with the pin, thereby eliminating the use of multiple welded plates. The one-piece cast traction pin is also solid to reduce the potential for stress related failure of the traction pin during normal operation of the railway car.

6 Claims, 9 Drawing Sheets

TRACTION PINS FOR RAILWAY CARS

This application claims priority to U.S. Provisional Application Ser. No. 60/207,080, filed May 25, 2000.

FIELD OF THE INVENTION

The present invention is directed generally to traction pins for railway car assemblies. More particularly, the present invention is directed to a cast, one-piece traction pin.

BACKGROUND OF THE INVENTION

The prior art traction pin assembly is a multi-piece component that connects a railcar cab or house assembly to the railcar truck. As conventional, the traction pin assembly is welded to the underside of the railcar cab and engages the railcar truck assembly permitting the truck assembly to turn, or swivel, independently of the cab.

As is known in the art, the traction pin assembly includes several components that are welded together and to the railcar cab. These components include a cylindrical pin and multiple mounting plates. The pin is welded to the mounting plates which, in turn, are welded to the underframe of the railcar cab. The mounted traction pin assembly is then received in a mating opening in the railcar truck to complete the joinder of the cab to the truck assembly. Once assembled, the traction pin permits rotatable movement of the railcar cab relative to the truck assembly.

Known drawbacks exist with respect to the conventional traction pin assemblies. By way of example, the use of multiple plates to attach the traction pin to the railcar cab add significant assembly time, labor, and expense. In addition, the multiple plates, which are typically made from rolled steel, have mechanical properties that are very dependent on the rolling direction of the plate. As a result, the mechanical properties may vary for each mounting plate used in a traction pin assembly. Also, known traction pins are hollow and thus define a wall that must have a critical wall thickness to withstand stresses encounted during normal operation of the railcar. Because the traction pin is made from cast steel, variations in wall thickness may occur. As such, if the wall thickness of the traction pin becomes too thin, there exists the potential for a failure of the traction pin. These and other known problems with existing traction pin assemblies are overcome with the present invention.

BRIEF SUMMARY OF THE INVENTION

Accordingly, it is an object of the present invention to eliminate the multiple components needed to mount the traction pin to the underframe of the railcar cab.

It is another object to reduce the time, labor and expense involved in mounting the traction pin to the railcar body.

It is a further object of the present invention to prevent stress related failure in the traction pin.

Yet a further object of the invention is to eliminate the problems associated with rolled plates used to mount the traction pin.

Still a further object is to provide a one-piece traction pin having a solid unitary structure.

In one embodiment, the present invention includes a one-piece, cast traction pin having a mounting plate cast integral with the pin. In an exemplary embodiment, the cast pin is solid, thereby reducing if not eliminating the potential for stress related failure of the pin during normal operation. With the present invention, the use of multiple rolled plates, which are welded together, and the disadvantages associated with such rolled plates are eliminated.

The full range of objects, aspects and advantages of the invention are only appreciated by a full reading of this specification and a full understanding of the invention. Therefore, to complete this specification, a detailed description of the invention follows, after a brief description of the drawings.

DETAILED DESCRIPTION OF THE INVENTION

Figure 1:
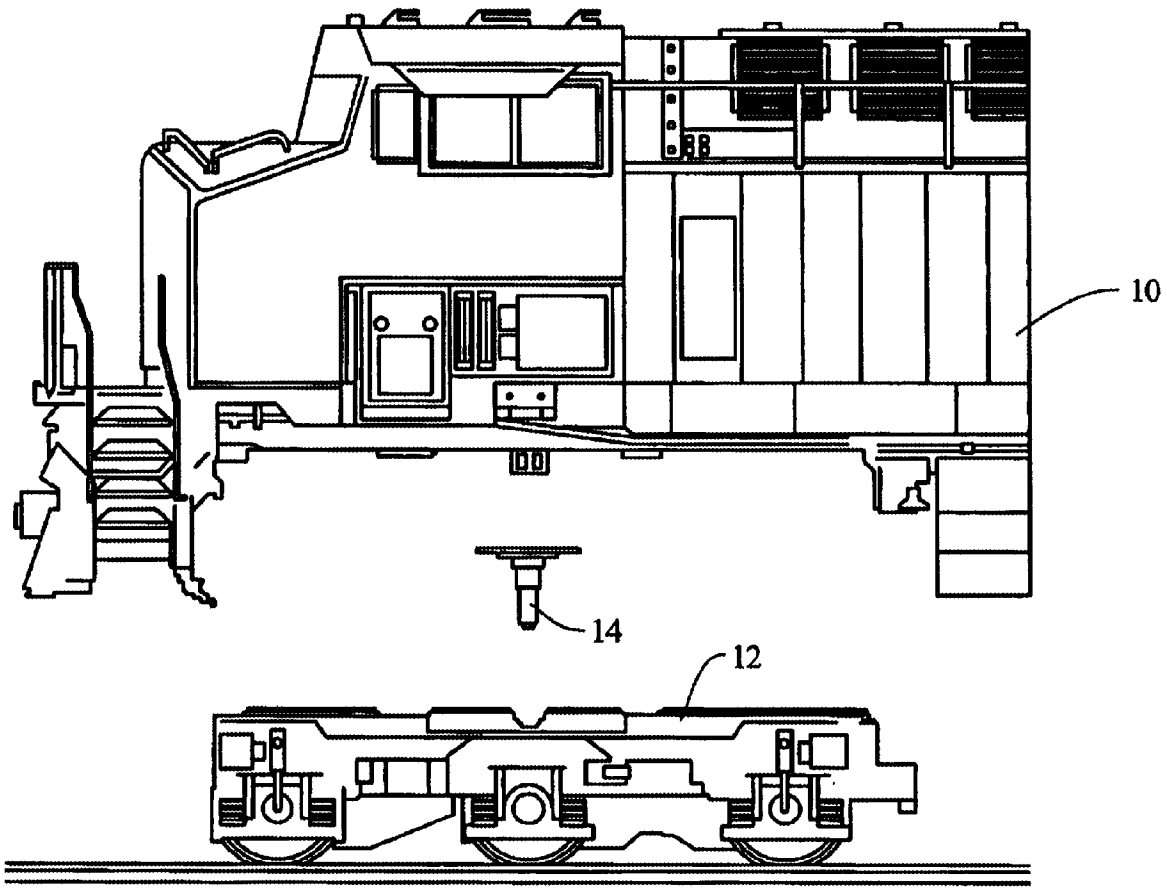
FIG. 1 (PRIOR ART)
FIG. 1 shows a prior art assembly of the railcar cab and truck.

Referring to the figures wherein like numerals indicate like elements, there is shown in FIG. 1 a railcar cab 10 and truck assembly 12. Located between and joining the railcar cab and truck assembly is a traction pin 14. As known by those of skill in the art, the traction pin serves to join the cab and truck assembly and permit rotatable movement of the cab relative to the truck assembly.

Figure 2:
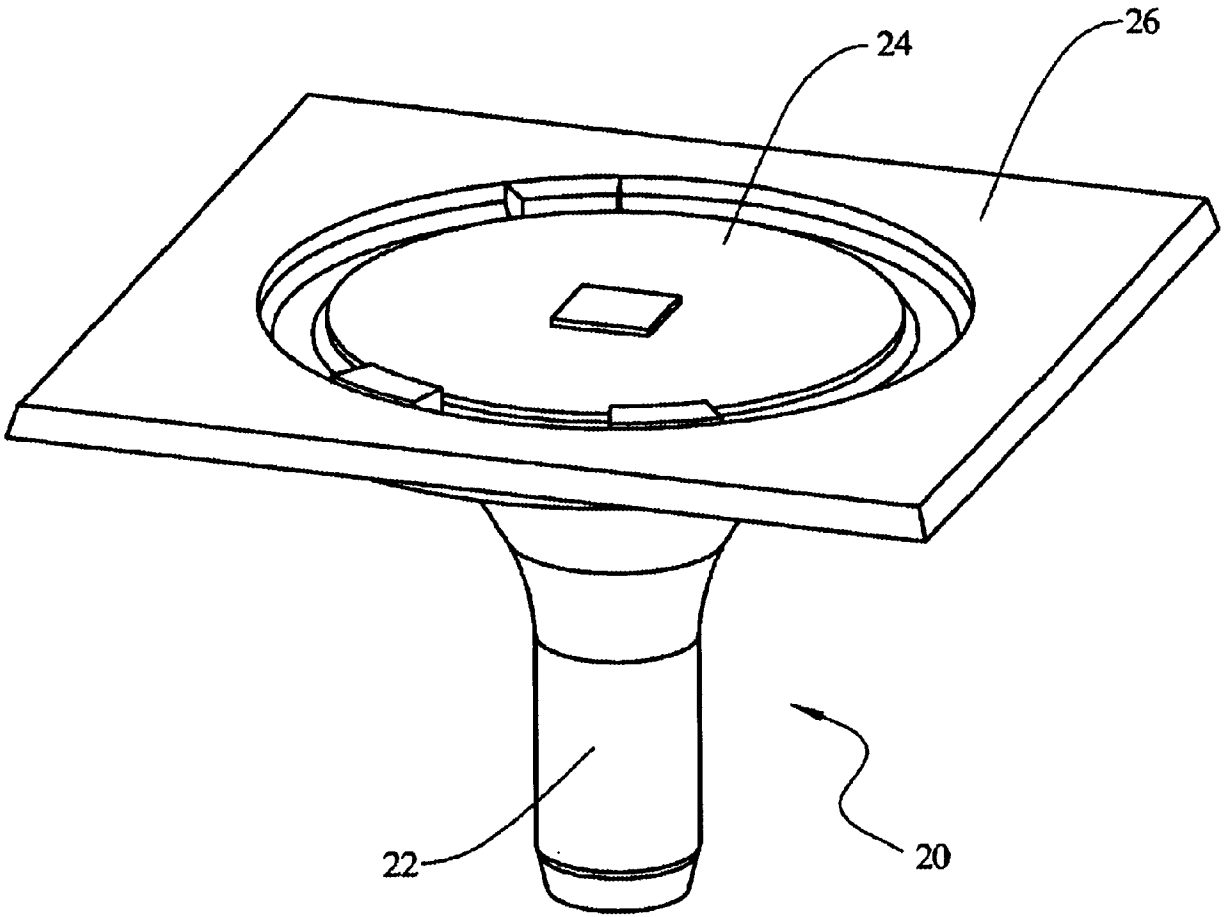
FIG. 2 (PRIOR ART)
FIG. 2 shows an isometric view of a prior art traction pin assembly.
Figure 3:
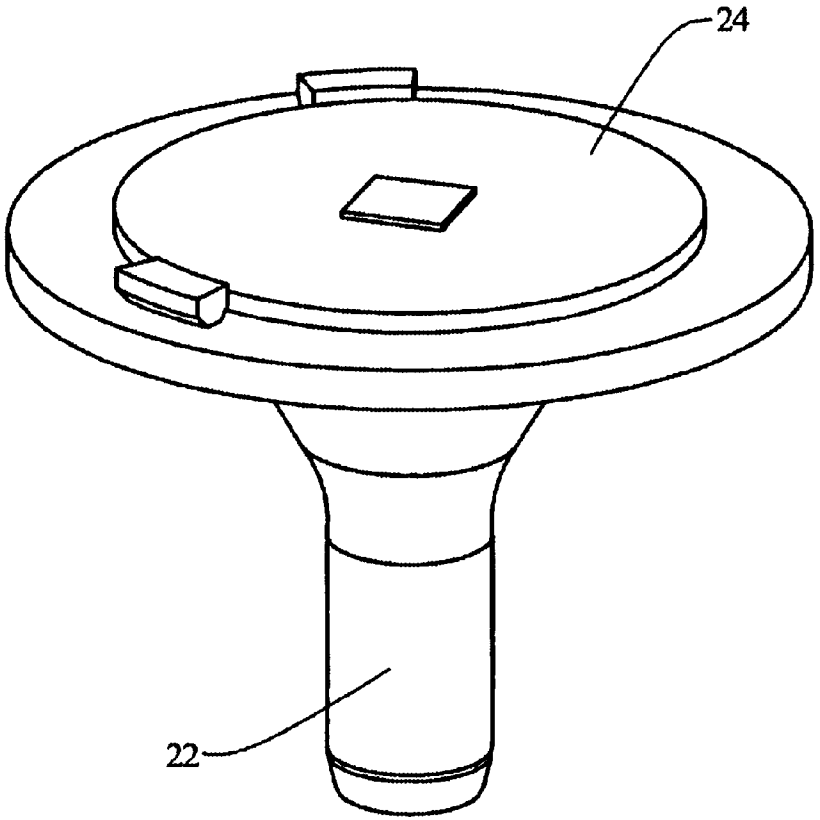
FIG. 3 (PRIOR ART)
FIG. 3 shows another isometric view of the prior art assembly of FIG. 2.
Figure 4:
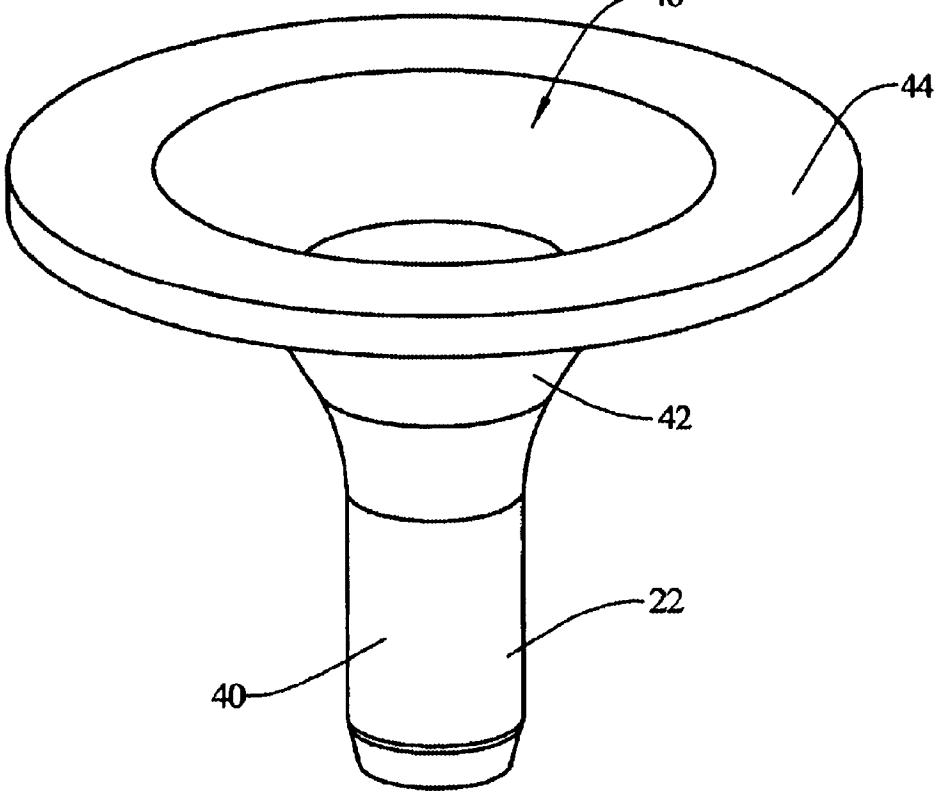
FIG. 4 (PRIOR ART)
FIG. 4 shows an isometric view of the prior art traction pin of FIG. 2.

Referring to FIGS. 2–4, there is depicted a prior art traction pin assembly 20 used to join a railcar cab and truck assembly. The prior art traction pin assembly includes a traction pin 22 and multiple plates welded to the traction pin 22. As conventional, the traction pin 22 is welded to a circular steel plate 24 and a square steel plate 26. The plates 24, 26 are, in turn, welded to the underframe of the cab or house assembly of the railcar. The steel plates 24, 26 are typically roll formed by a rolling mill and thus have mechanical properties dependent on the direction of the roll.

Figure 5:
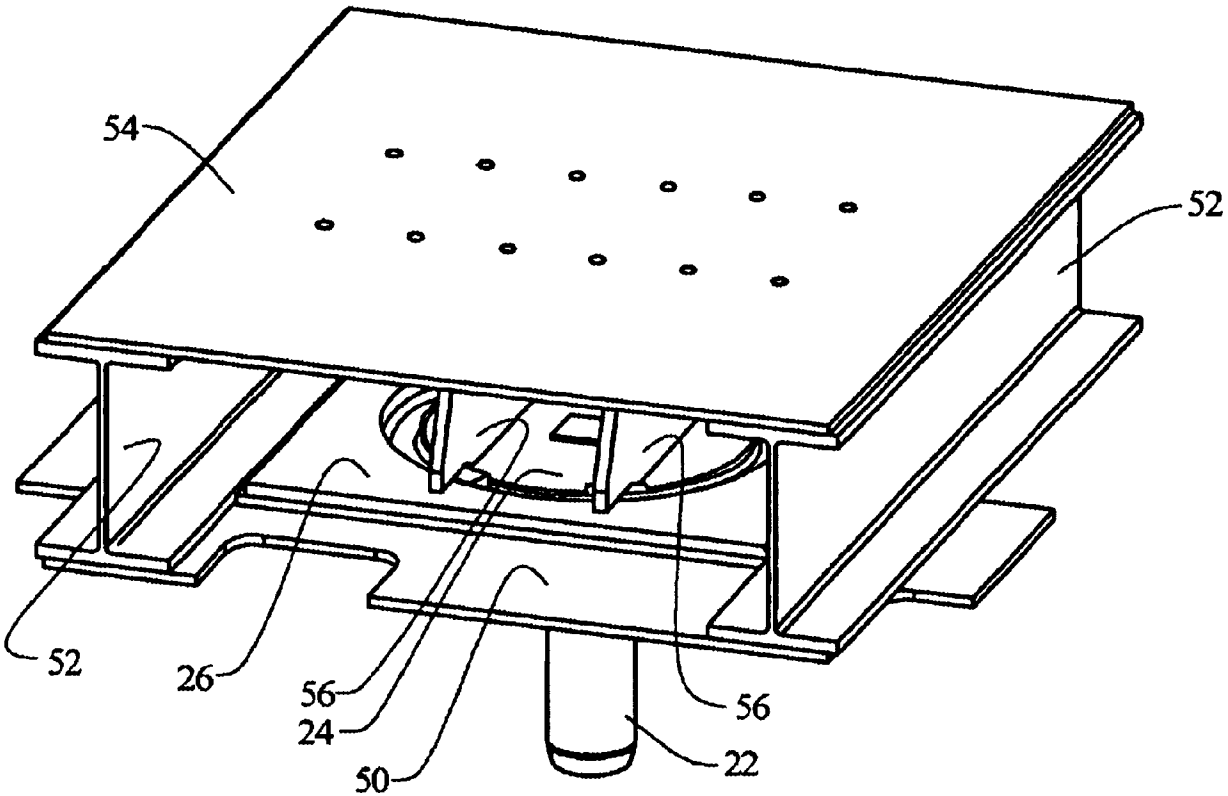
FIG. 5 (PRIOR ART)
FIG. 5 shows an isometric view of a prior art traction pin assembly.

Referring to FIG. 5, the traction pin assembly 20 is mounted to several components of the underframe of the cab. As depicted, the square steel plate 26 is welded to bottom plate 50. Plate 50 is welded to main sills 52 which are located between the bottom plate 50 and a top plate 54. Reinforcing members 56 are also located between the circular plate 24 and the top plate 54. The top plate 54 is welded to the underframe of the railcar cab.

Referring back to FIG. 4, as is known in the art, the traction pin 22 typically includes a cylindrical shaft 40, a frustum region 42 that flares outwardly from the cylindrical shaft to an outer circular rim 44. As known by those skilled in the art, the prior art traction pin 22 forms a hollow opening or cavity 46 within the traction pin. Because the pin 22 includes the opening 46, the pin defines a cylindrical wall that must have a wall thickness to withstand the stresses encounted by the pin during normal operation of the railcar.

As stated above, as assembled, the shaft 40 of the pin 22 is received in a mating opening in the housing of the truck casting, not shown, to mount the railcar cab to the truck assembly. The pin 22 thus permits the rotatable movement of the cab relative to the truck assembly.

Figure 6:
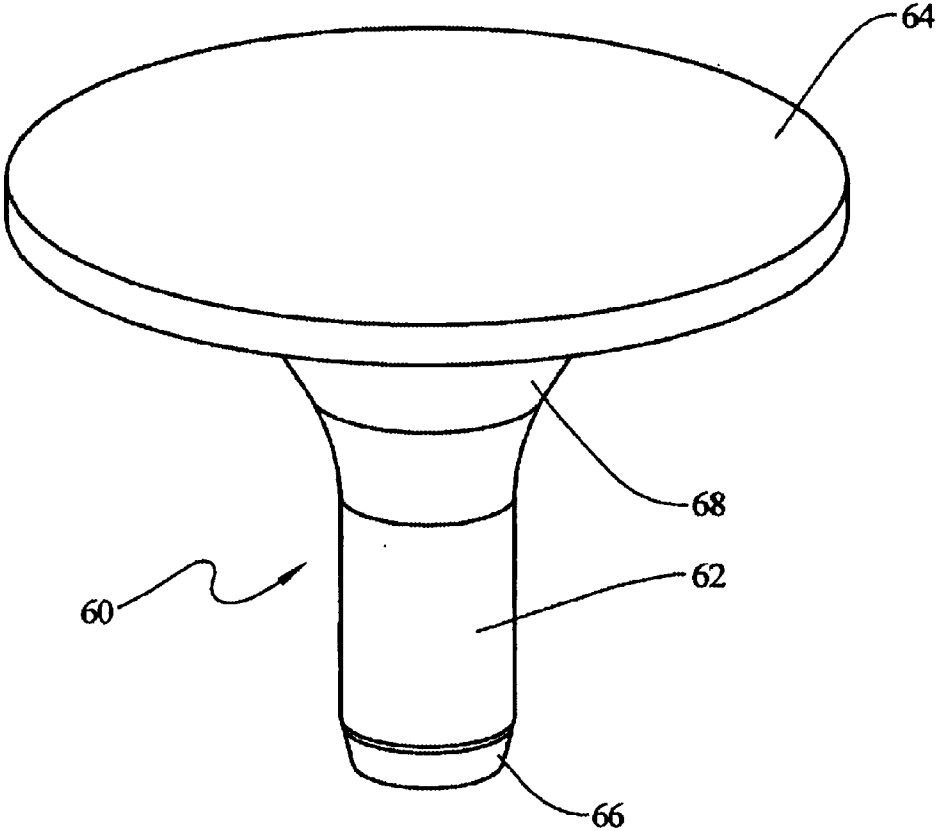
FIG. 6 shows an isometric view of a traction pin of the present invention.

Referring to FIG. 6, there is depicted one embodiment of the present invention. As depicted, a traction pin 60 includes a cast, one-piece pin body 62 with an integral mounting plate 64. As cast, the hollow opening or cavity previously formed in conventional traction pins is now filled-in with steel, creating a solid pin. The solid pin reduces, if not eliminates, the potential for traction pin failure. The pin body is cylindrical and may include a tapered end 66. The pin body 62 may also include a frustum shaped or flared region 68 extending outwardly from the pin body. The frustum region 68 flares outwardly to form and define the mounting plate 64. In other words, the frustum region is formed integral with the mounting plate. The mounting plate 64, as depicted, is circular in shape. However, it will be understood by those of skill in the art that the mounting plate is not limited to a circular shape. Other non-circular shapes for the plate 64 may be used with the present invention. It will be further understood by those skilled in the art that other shapes of the pin body, including the frustum region, are possible with the present invention.

Figure 7:
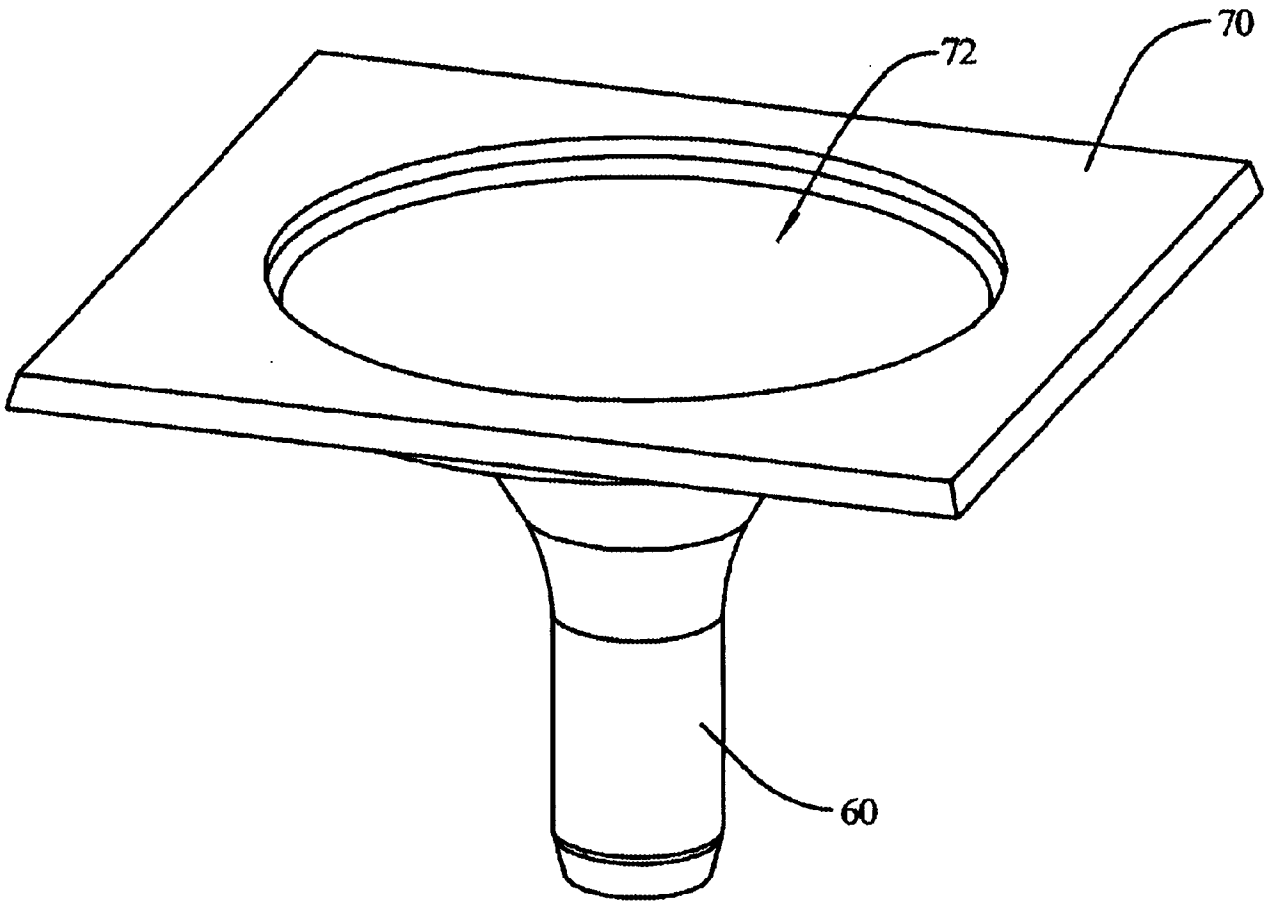
FIG. 7 shows an isometric view of a traction pin assembly of the present invention.

Referring to FIG. 7, the traction pin 60 is welded to a mounting plate 70 having a central opening 72. As depicted, the mounting plate 70 is rectangular in shape and includes a circular opening 72. Again, those of skill in the art will recognize that the present invention is not limited to the shape of the plate or opening as depicted in FIG. 7.

Figure 8:
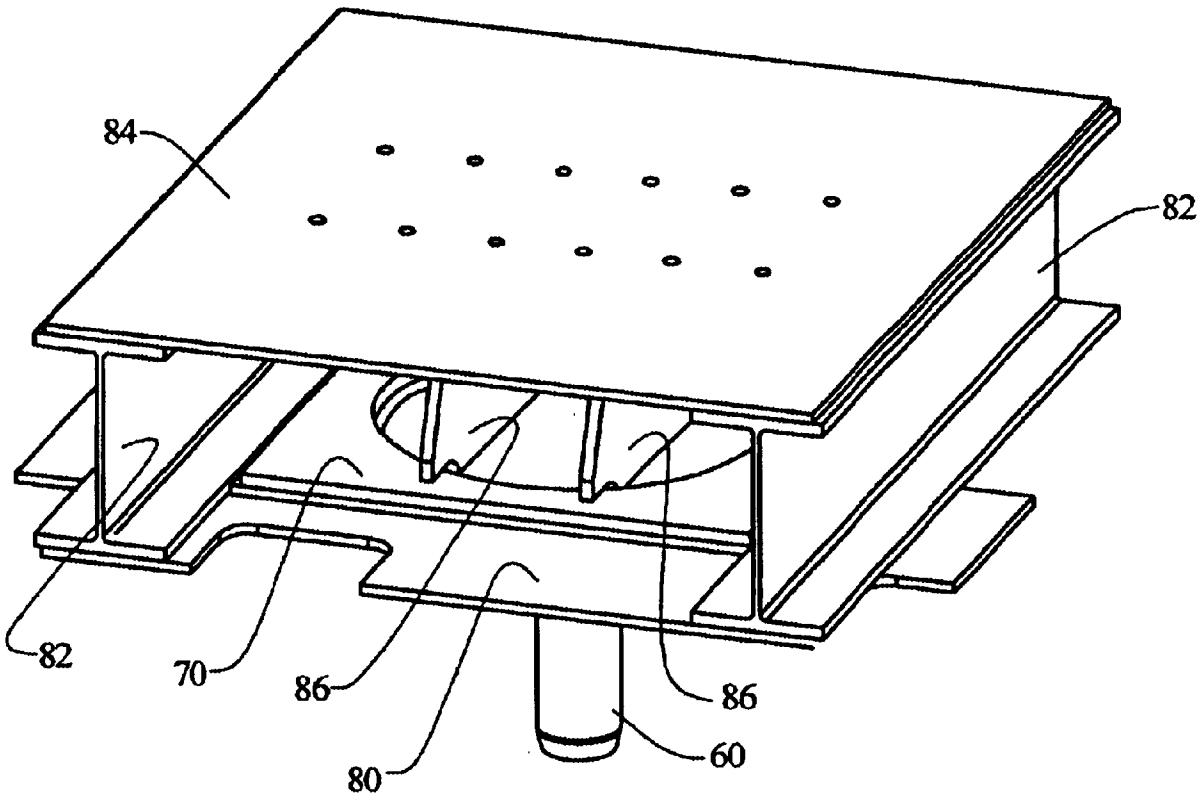
FIG. 8 shows another isometric view of a traction pin assembly of the present invention.

As shown in FIG. 8, the mounting plate 70 is welded to bottom plate 80. The plate 80 may be welded to main sills 82 which are located between the bottom plate 80 and a top plate 84. Similar to the assembly depicted in FIG. 5, reinforcing members 86 may be located between the circular plate 64 of the traction pin 60 and the top plate 84. As conventional, the top plate 84 is welded to the underframe of the railcar cab.

Significantly, the integral one-piece traction pin eliminates the multiple welded plates and the disadvantages associated with the use of such plates. In addition, with the inventive cast traction pin, the problems encounted with the traction pin having a hollow interior and with the use of roll formed plates are also eliminated.

Figure 9:
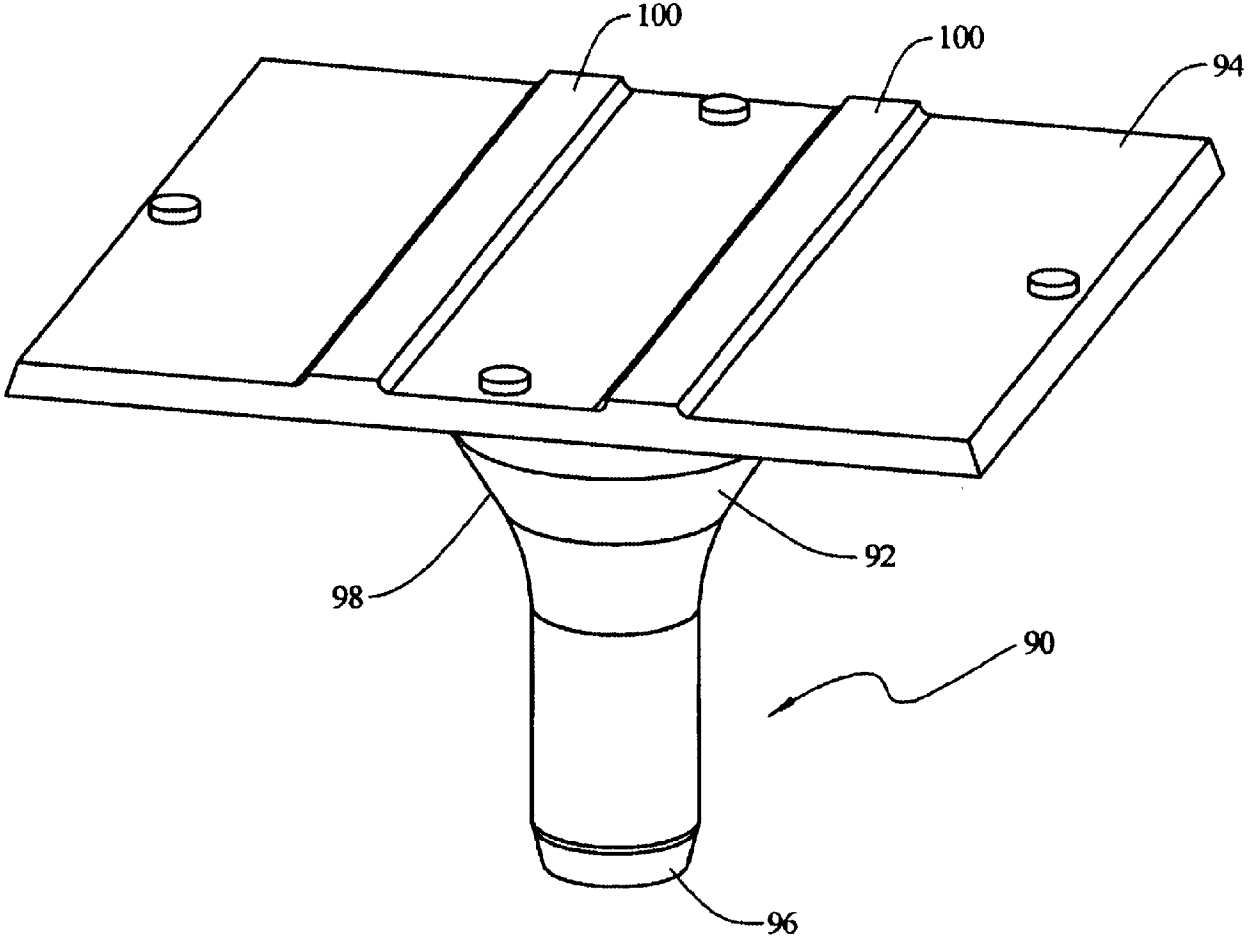
FIG. 9 shows an isometric view of an alternative embodiment of the present invention.

Referring to FIG. 9, there is depicted an alternative embodiment of the present invention. With this embodiment, the plate 70, depicted in FIG. 7, is cast integral with the traction pin 60, depicted in FIG. 6. Specifically, a traction pin 90 is illustrated and includes a cast, one-piece pin body 92 with an integral mounting plate 94. As with the embodiment of FIG. 6, the hollow opening or cavity previously formed in conventional traction pins is filled-in with steel, creating a solid pin having a unitary structure. In this embodiment, the pin body is again cylindrical and may include a tapered end 96. The pin body 92 may also include a frustum shaped or flared region 98 extending outwardly from the pin body. The frustum region 98 flares outwardly and is formed integral with the mounting plate 94. As depicted, the mounting plate 94 has a rectangular or non-circular shape. However, one skilled in the art will understand that other shapes and configurations for the plate 94 may be used with the invention and are considered to be within the scope of the same. Located on the top surface of the mounting plate 94 are raised surfaces 100 that are machined flat to enhance the mounting or welding of the reinforcing members 86, described above, to the mounting plate 94. Note that the invention may be used without the machined surfaces 100 if reinforcing members 86 are not used as part of the traction pin assembly.

While the invention has been described with respect to specific embodiments, those skilled in the art will appreciate and understand that there are numerous variations and permutations of the above described embodiments that fall within the spirit and scope of the invention as set forth in the appended claims.

What is claimed is:

1. A traction pin assembly for joining a railcar cab with a railcar truck assembly comprising:

a one-piece cast traction pin body defining a mounting plate and a cylindrical pin, the traction pin body further defining a non-hollow unitary structure and including a frustum region extending from the mounting plate to the cylindrical pin, the frustum region formed integral with the mounting plate, the mounting plate defining a pair of raised, spaced-apart mounting surfaces;

a pair of reinforcing ribs welded to the pair of mounting surfaces;

a rectangular plate defining a circular opening for receiving the mounting plate of the traction pin body, the traction pin body welded to the rectangular plate, the pair of reinforcing ribs extending through the circular opening;

a bottom mounting plate welded to the rectangular plate;

a pair of sills, each sill defining a first side and a second side, the first side welded to the bottom mounting plate; and a top mounting plate welded to the second side of each of the sills, the top mounting plate welded to the railcar cab, the pair of reinforcing ribs positioned between the mounting plate and the top mounting plate.

2. The traction pin assembly of claim 1 wherein the traction pin body defines a tapered end.

3. A traction pin assembly for joining a railcar cab with a railcar truck assembly comprising:

a one-piece cast traction pin having a non-hollow unitary structure and defining a body having cylindrical pin region and a frustum region extending from the cylindrical pin region, the traction pin also defining an integral mounting plate extending outwardly from the frustum region, the integral mounting plate defining a pair of raised, spaced-apart mounting surfaces;

a pair of reinforcing ribs welded to the pair of mounting surfaces;

a bottom mounting plate welded to the integral mounting plate of the traction pin;

a pair of sills, each sill defining a first side and a second side, the first side welded to the bottom mounting plate; and a top mounting plate welded to the second side of each of the sills, the pair of reinforcing ribs positioned between and mounted to the integral mounting plate and the top mounting plate, the top mounting plate welded to the railcar cab.

4. The traction pin assembly of claim 3 wherein the traction pin body defines a tapered end.

5. The traction pin assembly of claim 3 wherein the integral mounting plate has a rectangular shape.

6. The traction pin assembly of claim 3 wherein the integral mounting plate has a non-circular shape.

* * * * *